US006228445B1

(12) United States Patent
Tverberg

(10) Patent No.: US 6,228,445 B1
(45) Date of Patent: May 8, 2001

(54) AUSTENITIC STAINLESS STEEL ARTICLE HAVING A PASSIVATED SURFACE LAYER

(75) Inventor: John C. Tverberg, Mukwonago, WI (US)

(73) Assignee: Crucible Materials Corp., Syracuse, NY (US)

( * ) Notice: Subject to any disclaimer, the term of this patent is extended or adjusted under 35 U.S.C. 154(b) by 0 days.

(21) Appl. No.: 09/286,672

(22) Filed: Apr. 6, 1999

(51) Int. Cl.[7] ..... A47G 19/22

(52) U.S. Cl. ..... 428/34.4; 428/469; 428/472; 428/472.2

(58) Field of Search ..... 428/472, 472.2, 428/34.4, 469

(56) References Cited

U.S. PATENT DOCUMENTS 5,259,935 * 11/1993 Davidson et al. ..... 204/129.1

* cited by examiner

*Primary Examiner*—Timothy M. Speer
(74) *Attorney, Agent, or Firm*—Finnegan, Henderson, Farabow, Garrett & Dunner, L.L.P.

(57) ABSTRACT

An austenitic stainless steel article, preferably in the form of a tubing. The article has a passivated surface layer, which in the case of a tubing is on the interior surface of the tubing. The passivated surface layer has an oxide component having $Fe_2O_3$ and $Cr_2O_3$ and a metal component of Fe with zero valence and Cr with zero valence. The ratio of the oxide component to the metal component is in excess of 8:1.

20 Claims, 11 Drawing Sheets

Change in Surface Composition as a Function of Passivation Time, Expanded Scale

Change in Surface Composition as a Function of Passivation Time, Expanded Scale

Change in Surface Composition as a Function of Passivation Time

Metal to Iron Ratio as a Function of Passivation Time

Change in Ratio of $Cr_2O_3$:Cr and $Fe_2O_3$:Fe as a Function of Passivation Time

Iron Binding Energy Scan of As-Received Material Showing Relative Iron Oxide ($Fe_2O_3$) and Free Iron ($Fe^o$)

Iron Binding Energy Scan After One Minute Passivation Illustrating the Decrease in Oxide and Increase in Free Iron (Fe°)

Chromium Binding Energy Scan of As-Received Material Showing Relative Chromium Oxide ($Cr_2O_3$) to Free Chromium ($Cr^o$) Levels Chromium Binding Energy Scan of 60 Minute Nitric Acid Passivated Material Showing the Decrease in Free Chromium ($Cr^o$)

Iron Binding Energy Scan of 60 Minute Nitric Acid Passivated Material Showing Significant Residual Free Iron ($Fe^o$)

AUSTENITIC STAINLESS STEEL ARTICLE HAVING A PASSIVATED SURFACE LAYER

BACKGROUND OF THE INVENTION

1. Field of the Invention

The invention relates to an austenitic stainless steel article, particularly in the form of a tubing, having a passivated surface layer.

2. Description of the Prior Art

In the manufacture of austenitic stainless steel articles, and particularly tubing of austenitic stainless steel, it is desirable that the surface thereof be passivated so that during use the surface will not oxidize or otherwise react with environments to which it is subjected during use. Particularly, in the case of austenitic stainless steel tubing, specifically AISI type 316 stainless steel tubing as used in the pharmaceutical industry, during use the interior surface develops a reaction product in the form of an oxide exhibiting a reddish color. This phenomenon is typically termed "rouging." This reaction product may constitute a source of contamination for product passing through the tubing during use thereof in various industrial applications.

OBJECTS OF THE INVENTION

It is accordingly a primary object of the present invention to provide an austenitic stainless steel article, particularly a tubing, having a passivated surface layer that will not develop rouging during exposure to oxidizing environments during use.

SUMMARY OF THE INVENTION

In accordance with the invention, a stainless steel article, which may be in the form of a tubing, has a passivated surface layer of $Cr_2O_3$ and $Fe_2O_3$ with a metal component of Cr with a valence of zero and Fe with a valence of zero. The ratio of the oxide component to the metal component is in excess of 8 to 1.

Preferably, the stainless steel is an austenitic stainless steel.

Preferably, the stainless steel is AISI type 316 austenitic stainless steel.

Preferably, the outside surface of the passivated surface layer will have a total Cr to Fe ratio of at least 1 to 1.

The passivated surface layer may at a depth therein of a maximum oxygen concentration have a total Cr to Fe ratio of at least 1.5 to 1. The passivated surface layer preferably constitutes an electropolished surface but may also be a mechanically polished surface, produced for example by swirl or belt polishing.

The reference to "total Cr to Fe ratio" includes the Fe and Cr present in the oxide component.

The term "electropolished" means a metallic bright surface created through a combination of electrical action and an acid solution, one component of which is phosphoric acid, the other usually sulfuric acid.

All compositions are in weight percent unless otherwise indicated.

DESCRIPTION OF THE PREFERRED EMBODIMENTS

Preferably in accordance with the invention, the desired passivated surface layer is achieved by an electropolishing operation, an electropolishing together with an oxidizing acid, or a mechanically polished surface treated with an oxidizing acid. The passivation process to produce the passivated surface layer in accordance with the invention, is therefore achieved by exposure of the surface to an oxidizing acid after it has been preferably electropolished or otherwise abraded, such as by a grit polishing operation. In this operation, the surface is specifically altered by increasing the chromium to iron ratio; removing surface roughness; providing for increased depth of oxygen penetration; removal of contamination, such as occluded iron, or removal of strain transformed martensite; removal of inclusions, especially manganese sulfides; and removal of visible manufacturing defects.

Figure 7:
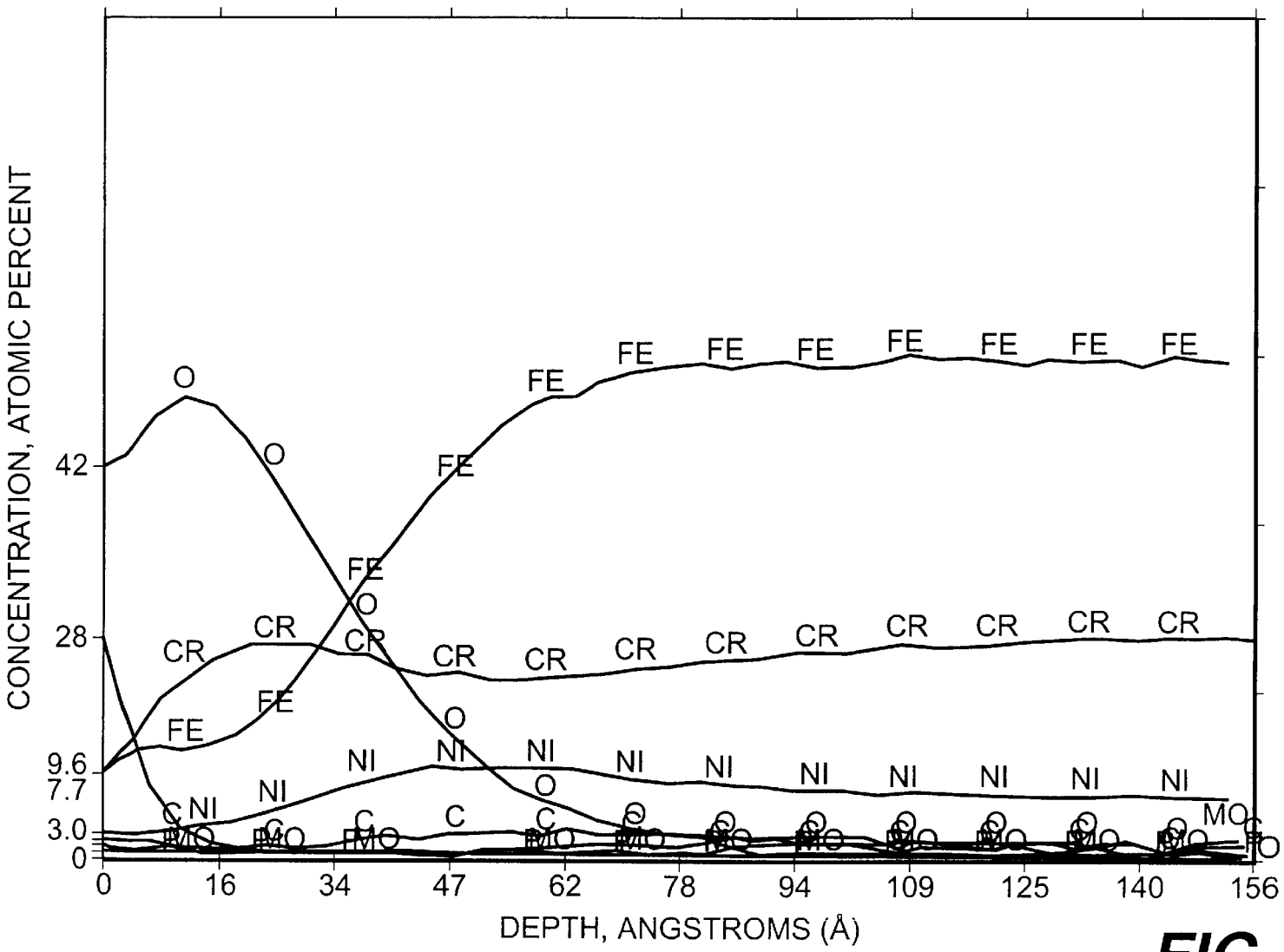
FIG. 7 is a graph constituting a depth profile using Auger Electron Spectroscopy of an electropolished and passivated surface.
Figure 8:
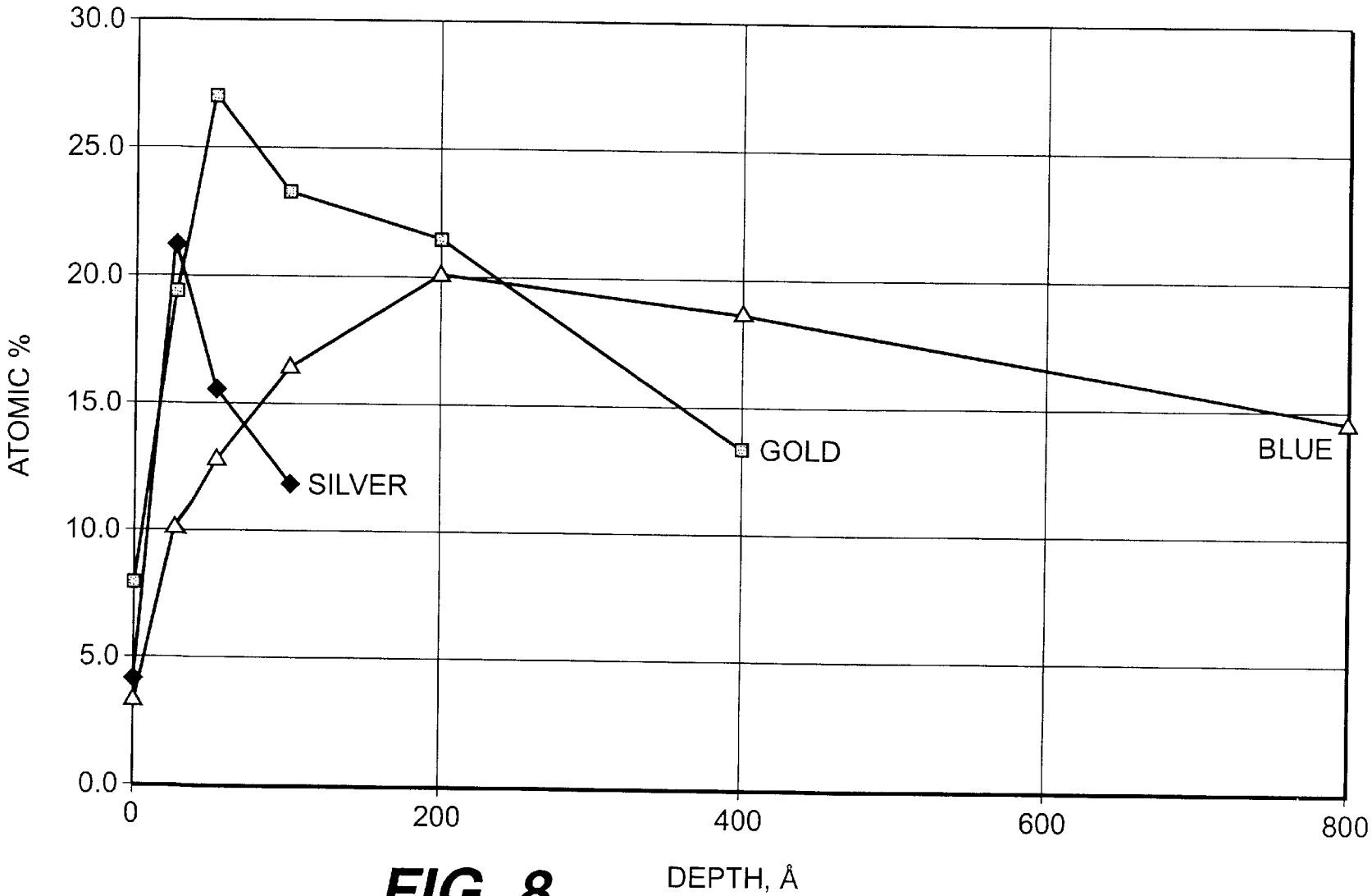
FIG. 8 is a graph constituting a depth profile of three different color tinted electropolished surfaces illustrating color variation as a function of chromium content.

During the passivation process, which partially can occur in air within several hours after the stainless steel surface has been abraded or otherwise altered, such as by electropolishing, the chromium combines with oxygen and forms an impervious chromium oxide barrier to further reaction of the material below this passive or barrier film. It has been determined that as the chromium content increases, the film becomes a better barrier. During electropolishing, the iron and other elements on the surface are preferentially removed to increase the chromium on the surface. Consequently, after electropolishing, the chromium to iron ratio is significantly increased on the passivated surface layer. The average depth of oxygen penetration, as seen in FIG. 7, is a measure of the depth of the passivated layer. In general, the deeper the oxygen penetration, the thicker the passive layer and the more corrosion resistance the material will have. This is true, however, only if the oxide components are substantially $Cr_2O_3$ and $Fe_2O_3$ in combination with the metal components Cr and Fe both having zero valence with $Cr_2O_3$ to $Fe_2O_3$ ratio being relatively high. This may be achieved by subjecting the polished surface to an oxidizing acid such as nitric acid ($HNO_3$) or citric acid for a period determined suitable to complete reaction to $Cr_2O_3$ and $Fe_2O_3$. The change in the composition may be seen as a function of the depth of the passivated layer from FIG. 7.

Passivation has a profound effect on the chromium-to-iron ratios in mechanically polished Type 316L stainless steel tubing. Pieces of the same tube were subjected to hot nitric acid for various passivation times and the passive layer was analyzed using XPS (X-Ray Photoelectron Spectroscopy). The changes in surface chemistry, especially with regard to the amount of elemental iron in the passive layer, were very measurable. There were significant differences in the Cr:Fe ratio and in the ratio of elemental chromium to chromium oxide. Other elements that exhibited anomalous behavior were silicon and molybdenum. More elemental iron and chromium exist in the passive layer of the mechanically polished tubing than the equivalent electropolished tube, suggesting a more easily corroded surface for the mechanically polished tubing.

Type 316L stainless steel is the material of choice for most High Purity Water (HP) and Water for Injection (WFI) systems in the pharmaceutical industry. Two surface finish conditions are used for these systems: electropolished and mechanically polished. The tubing is usually ordered to specification ASTM A 270, which in its present format requires a mechanical polishing regardless of the existing surface smoothness. Mechanical polishing takes one of two forms, swirl polishing or longitudinal belt polishing. Swirl polishing uses a rotating flapper wheel which moves up and down the length of the tube removing only a thin surface layer of material, and creating a "smeared surface." The longitudinal belt polish uses an abrasive belt that moves along the length of the tube, while the tube rotates and uses an air bladder to pressurize the belt to remove surface material. This technique removes a measurable amount of material, 0.0006–0.0008 inch (0.015–0.020 mm), and is a precursor to electropolishing to low Ra levels (<8$\mu$-in or 0.2 $\mu$m). Both methods remove the normal deep passive layer that is developed during production of the stainless steel strip from which the tubing is made.

Occasionally discoloration of the mechanically polished surface results, especially during hot, humid weather. This is seen with both types of mechanically polished tubing. This surface discoloration varies from light yellow to a light red. It is readily removed by immersion in hot nitric acid followed with a water rinse. Once the tube is acid treated it does not discolor again providing the treatment takes place at an elevated temperature for a sufficiently long period of time.

A study was initiated to determine what changes occur in the surface of mechanically polished tubing at several nitric acid passivation times. The acid concentration was that specified in MIL STD QQ-P-35 and ASTM A 967—Nitric Acid 3, namely 20% at the specified temperature of 120–140° F. (50–60° C.). This concentration and temperature provided the best results with the standard salt spray test. In this study, the time at temperature was varied and the surfaces analyzed using X-Ray Photoelectron Spectroscopy (XPS). The results of the passivation study are presented as follows.

Reagent grade nitric acid was diluted with deionized water to 20 volume percent (v/o) and heated to a constant 136° F. (58° C.). Five samples of mechanically polished tubing were immersed in this solution, one each for 1, 5, 15, 30, and 60 minutes, respectively. One sample was analyzed in the "as polished" condition. After rinsing and drying, each of the treated mechanically polished samples was evaluated using XPS. There was no visual difference among the six samples. All had identical surface lusters.

X-ray photoelectron spectroscope is one of the newer analytical tools available and is also known as Electron Spectroscopy for Chemical Analysis, or ESCA. During XPS, a sample is irradiated with monoenergic soft x-rays and the emitted photoelectrons analyzed for energy response. For this experiment, monochromatic A1 K$\alpha$ x-rays at 1486.7 electron volts were used. These x-rays interact with the atoms on the surface and emit photoelectrons. These photoelectrons are generated within approximately 30–50 Å of the surface with a resulting kinetic energy expressed as:

$$KE = h\nu - BE - \phi s$$

where:

KE is the Kinetic energy;

hv is the energy of the photon;

BE is the binding energy of the atomic orbital from which the electron originates; and $\phi$s is the spectrometer work function.

Each element and compound has a unique set of binding energies. Therefore, XPS can be used to identify the concentration of elements on the surface being analyzed and determine the binding energy of the surface species. From this binding energy inferences can be made to identify the chemical state of the element. This is an extremely useful function because changes in the passive layer composition as a function of passivation time can be identified.

Following each surface scan the surface was bombarded ("sputtered") with ionized argon to remove about 25 Å of material (or about 8 atoms in depth), then the new surface was again analyzed. This continued until the maximum depth of oxygen penetration was reached or until there were no further changes in composition.

For each sample at each depth, a survey scan was made in the energy range of 1200–0 eV to determine the elemental composition. Then, for each element of interest, a narrow window of about 20 eV around the central peak was analyzed in a high energy resolution mode to determine the binding energy of the surface species. Peak shifting in XPS may be considered a measure of covalency, and the more ionic compounds such as intermetallic compounds may or may not be shifted significantly from the pure element peak value. The binding energy obtained for each element is compared to either published literature values of known standards or to theoretical standards based on chemical bonding. The presence of overlapping, multiple binding energies can make identification difficult. Data from the *Handbook of Photoelectron Spectroscopy,* J. F. Moulder et al., Physical Electronics, Inc., Eden Prarie, Minn., 1995 and *Practical Surface Analysis by Auger and X-Ray Photoelectron Spectroscopy,* D. Briggs et al., J. Wiley & Sons, Chichester, England, 1983 were used for the assignment of binding energy to compounds.

The XPS system used for the analyses was a Physical Electronics Model 5700. The binding energy values were calibrated with an internal standard, carbon from atmospheric exposure, set to 284.7 eV. Quantitative values for the data were obtained by the use of sensitivity factors set forth in the D. Briggs publication noted above, which are based on the calculated yields for pure elements. The analytical information should be taken as semi-quantitative at best and most properly be used for comparisons only.

Since all specimens were taken from the same tube and within one inch (25 mm) of each other, only one of the samples was analyzed in the as-received state, after an isopropanol rinse to remove contamination from handling. Each surface of the acid treated samples was analyzed with XPS. In addition, the as-received sample and the 30 and 60 minute passivated samples were sputtered to determine elemental composition and oxidation state as a function of depth.

Figure 1A:
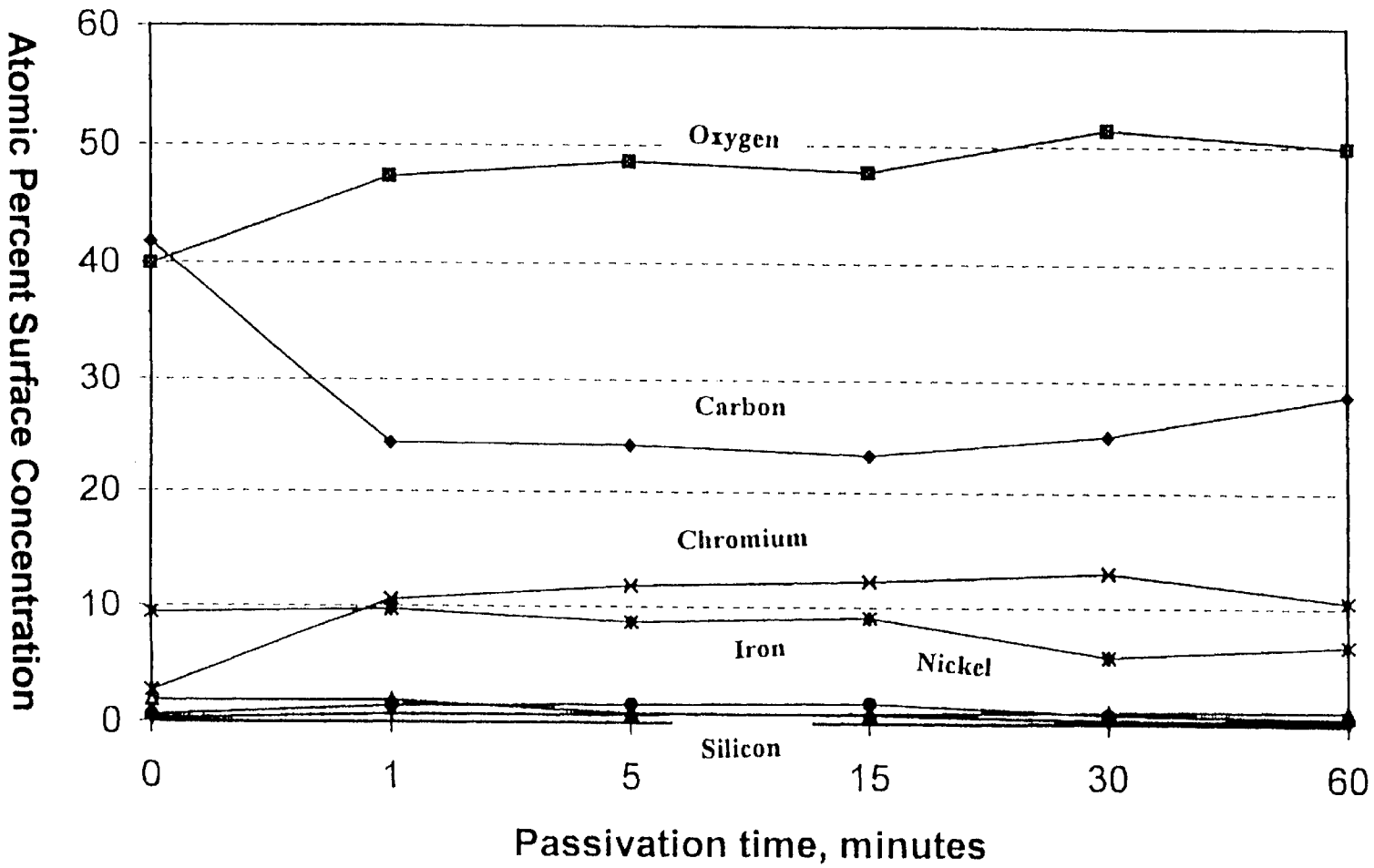
FIGS. 1*a* and 1*b* are graphs showing surface composition as a function of passivation time.
Figure 1B:
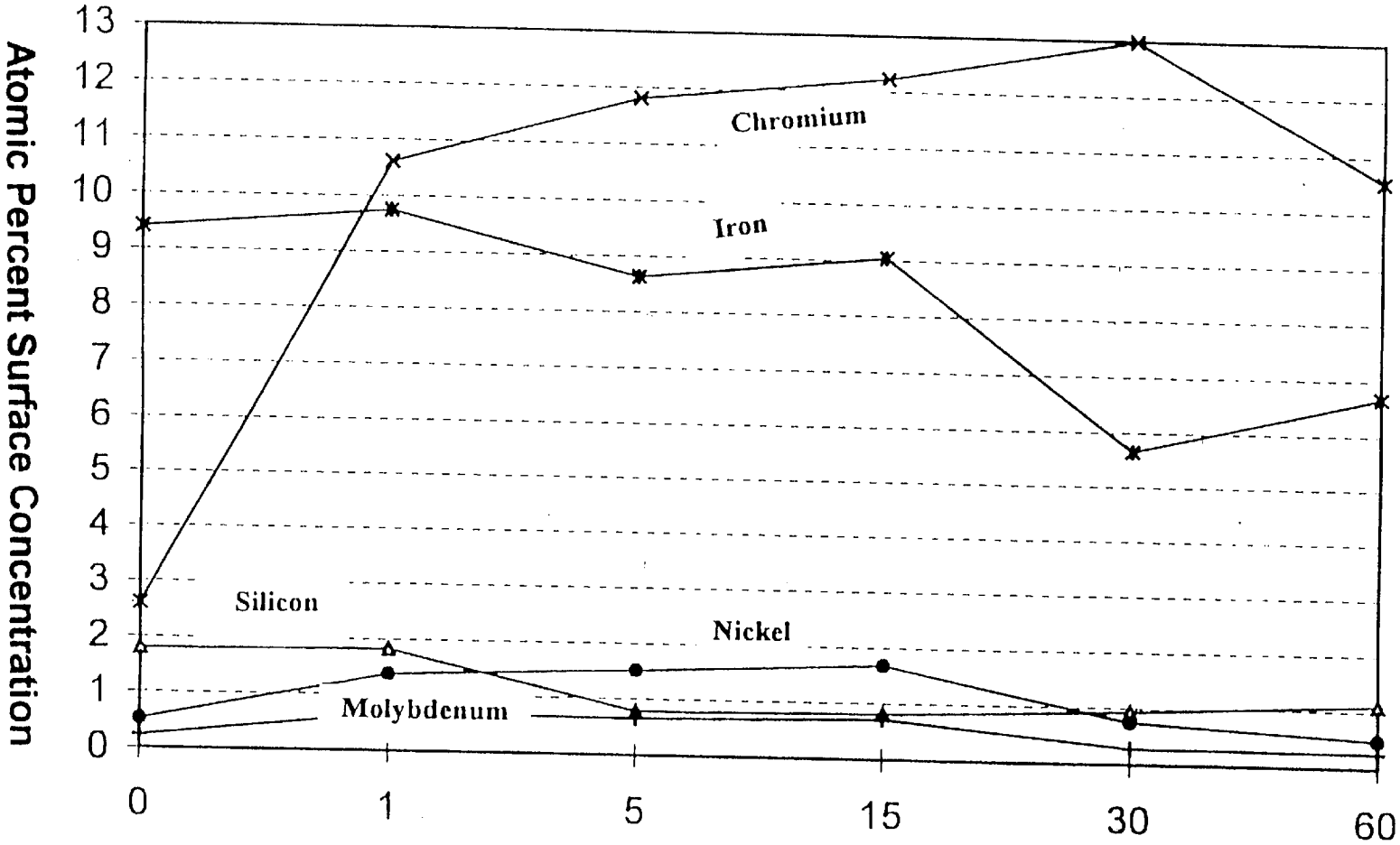

Table 1 summarizes the surface chemistry of the Type 316L Stainless Steel samples after the different times in hot nitric acid. The data represent the atomic percent composition of the elements above atomic number 3 within 40 Å (12 atoms) of the surface. FIGS. 1*a* and 1*b* are plots of the metals only atomic surface concentration as a function of passivation time.

TABLE 1

Elemental Surface Composition as a Function of Nitric Acid Passivation Time

| Passivation Time in Minutes | C | N | O | Na | Mg | Al | Si | P | S | Ca | Cr | Fe | Ni | Mo |
|---|---|---|---|---|---|---|---|---|---|---|---|---|---|---|
| 0 | 41.8 | 2.4 | 39.9 | 0.4 | — | — | 1.8 | — | 0.3 | — | 2.6 | 9.4 | 0.5 | 0.2 |
| 1 | 24.3 | 2.3 | 47.3 | 0.1 | 0.2 | 0.4 | 1.8 | 0.7 | 0.4 | 0.1 | 10.6 | 9.7 | 1.4 | 0.7 |
| 5 | 24.1 | 2.3 | 48.6 | 0.4 | — | 0.1 | 0.8 | 0.7 | 0.2 | 0.2 | 11.8 | 8.6 | 1.5 | 0.7 |
| 15 | 23.3 | 2.6 | 47.7 | 0.2 | 0.2 | 0.4 | 0.8 | 0.7 | 0.3 | 0.2 | 12.2 | 9.1 | 1.7 | 0.7 |
| 30 | 25.1 | 1.6 | 51.4 | — | — | 0.3 | 0.9 | 0.8 | — | 0.1 | 13.0 | 5.7 | 0.7 | 0.3 |
| 60 | 28.8 | 1.8 | 49.9 | — | — | — | 1.1 | 0.4 | — | — | 10.5 | 6.7 | 0.5 | 0.3 |

Figure 2:
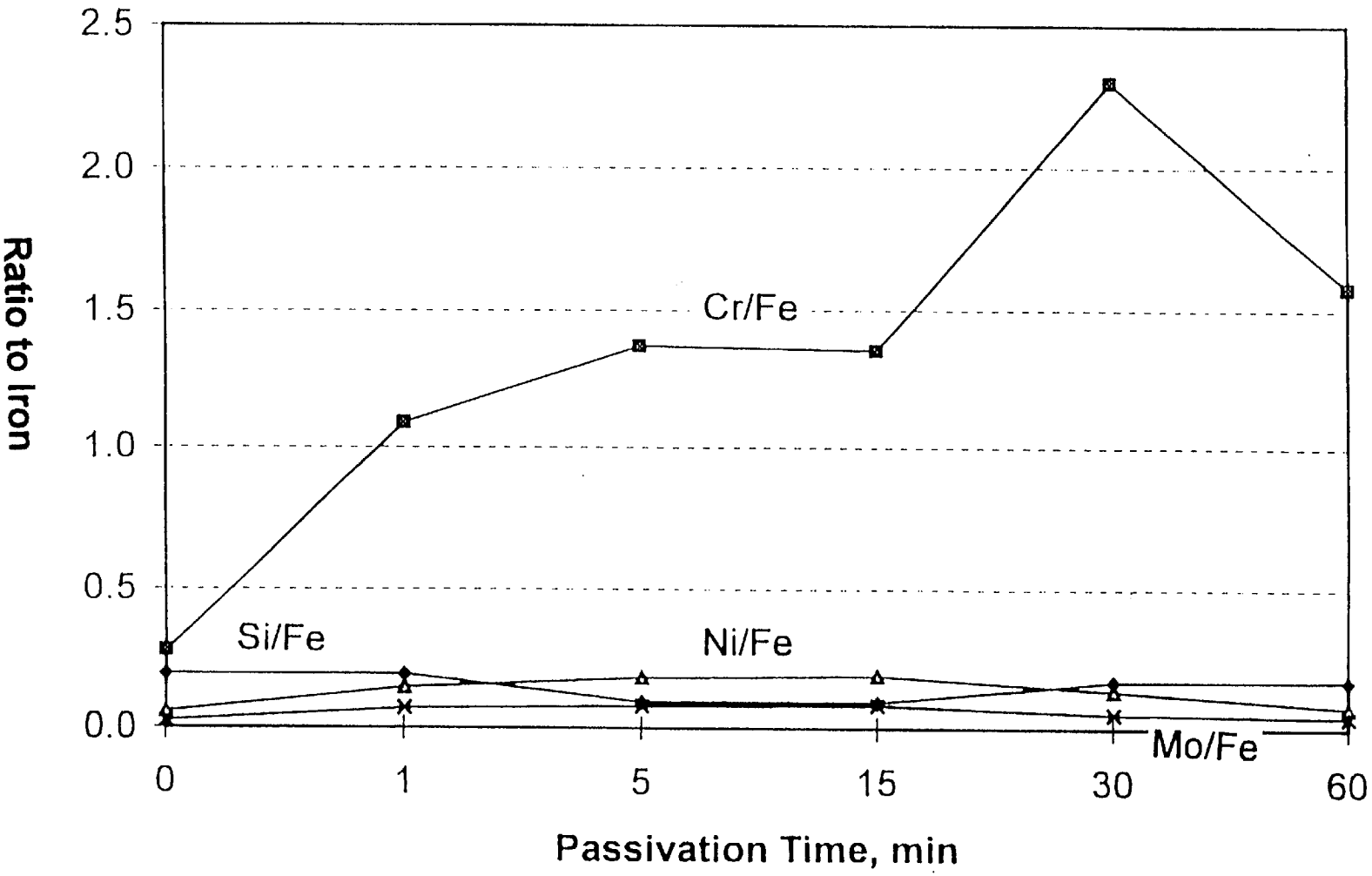
FIG. 2 is a graph showing metal to iron ratio as a function of passivation time.

The data illustrate that chromium and oxygen concentrations reach a maximum after 30 minutes of passivation and that iron has its lowest value. When the data are compared as the ratio of metal to iron as in Table 2 and FIG. 2, the maximum Cr/Fe ratio occurs after 30 minutes passivation. For some unexplained reason, both 15 and 60 minute passivation show a decrease in the Cr/Fe ratio. Both the Ni/Fe and Mo/Fe ratios reached a maximum at 15 minutes and began to decrease after 30 minutes of passivation.

TABLE 2

Ratio of Key Elements to Iron as a Function of Nitric Acid Passivation Time

| Passivation Time, Minutes | Si/Fe | Cr/Fe | Ni/Fe | Mo/Fe |
|---|---|---|---|---|
| 0 | 0.191 | 0.277 | 0.055 | 0.024 |
| 1 | 0.188 | 1.088 | 0.141 | 0.068 |
| 5 | 0.089 | 1.367 | 0.176 | 0.075 |
| 15 | 0.90 | 1.351 | 0.186 | 0.078 |
| 30 | 0.165 | 2.299 | 0.131 | 0.050 |
| 60 | 0.166 | 1.578 | 0.073 | 0.039 |

The 0, 30, and 60 minute passivated specimens were sputtered with ionized argon and the elemental composition as a function of depth was determined. The data are summarized in Table 3 for the as-received specimen. Table 4 for the 30 minute passivated specimen and Table 5 for the 60 minute passivated specimen.

TABLE 3

Composition as a Function of Depth for an As-Polished Specimen

| Depth, Å | C | N | O | Si | S | Ar | Cr | Fe | Ni | M |
|---|---|---|---|---|---|---|---|---|---|---|
| 0 | 41.8 | 2.4 | 39.9 | 1.8 | 0.3 | — | 2.6 | 9.4 | 0.5 | 0.2 |
| 25 | 4.1 | — | 32.7 | 0.6 | 0.2 | 1.2 | 13.4 | 42.2 | 4.6 | 0.7 |
| 50 | 4.2 | — | 14.9 | 0.8 | — | 2.1 | 11.0 | 59.2 | 6.5 | 1.2 |
| 100 | 3.8 | — | 9.4 | 0.9 | — | 2.5 | 13.4 | 63.5 | 4.8 | 1.6 |
| 200 | 2.1 | — | 7.2 | 0.6 | — | 2.5 | 15.0 | 65.7 | 4.8 | 1.9 |
| 400 | 1.5 | — | 5.4 | 0.9 | — | 2.5 | 15.8 | 66.1 | 5.7 | 2.0 |

TABLE 3-continued

Composition as a Function of Depth for an As-Polished Specimen

| Depth, Å | C | N | O | Si | S | Ar | Cr | Fe | Ni | M |
|---|---|---|---|---|---|---|---|---|---|---|
| 800 | 1.6 | — | 3.8 | 0.5 | — | 2.4 | 16.1 | 68.4 | 4.9 | 2.2 |
| 1600 | 1.4 | — | 3.1 | 0.3 | — | 2.5 | 16.6 | 68.8 | 4.8 | 2.2 |

TABLE 4

Composition as a Function of Depth for 30 Minute Nitric Acid Passivated Type 316L

| Depth, Å | C | N | O | Si | Ar | Ca | Cr | Fe | Ni | Mo |
|---|---|---|---|---|---|---|---|---|---|---|
| 0 | 2.51 | 1.6 | 51.4 | 0.9 | — | 0.1 | 13.0 | 5.7 | 0.7 | 0.3 |
| 25 | 3.7 | 0.2 | 48.1 | 0.7 | 1.4 | 0.1 | 21.5 | 20.4 | 3.0 | 0.5 |
| 50 | 3.1 | 0.3 | 43.3 | 0.7 | 1.7 | 0.1 | 20.6 | 26.1 | 3.2 | 0.6 |
| 100 | 2.3 | — | 39.3 | 0.2 | 2.0 | 0.1 | 20.9 | 31.4 | 2.9 | 0.8 |
| 200 | 1.9 | — | 34.4 | 0.3 | 2.2 | 0.1 | 20.7 | 36.4 | 3.1 | 0.9 |
| 400 | 2.1 | — | 28.8 | — | 2.3 | — | 19.3 | 42.8 | 3.3 | 1.2 |
| 800 | 1.8 | — | 21.2 | — | 2.3 | 0.1 | 18.4 | 50.7 | 4.1 | 1.5 |
| 1600 | 1.9 | — | 11.6 | — | 2.4 | 0.1 | 17.4 | 59.9 | 4.8 | 1.9 |

Figure 3:
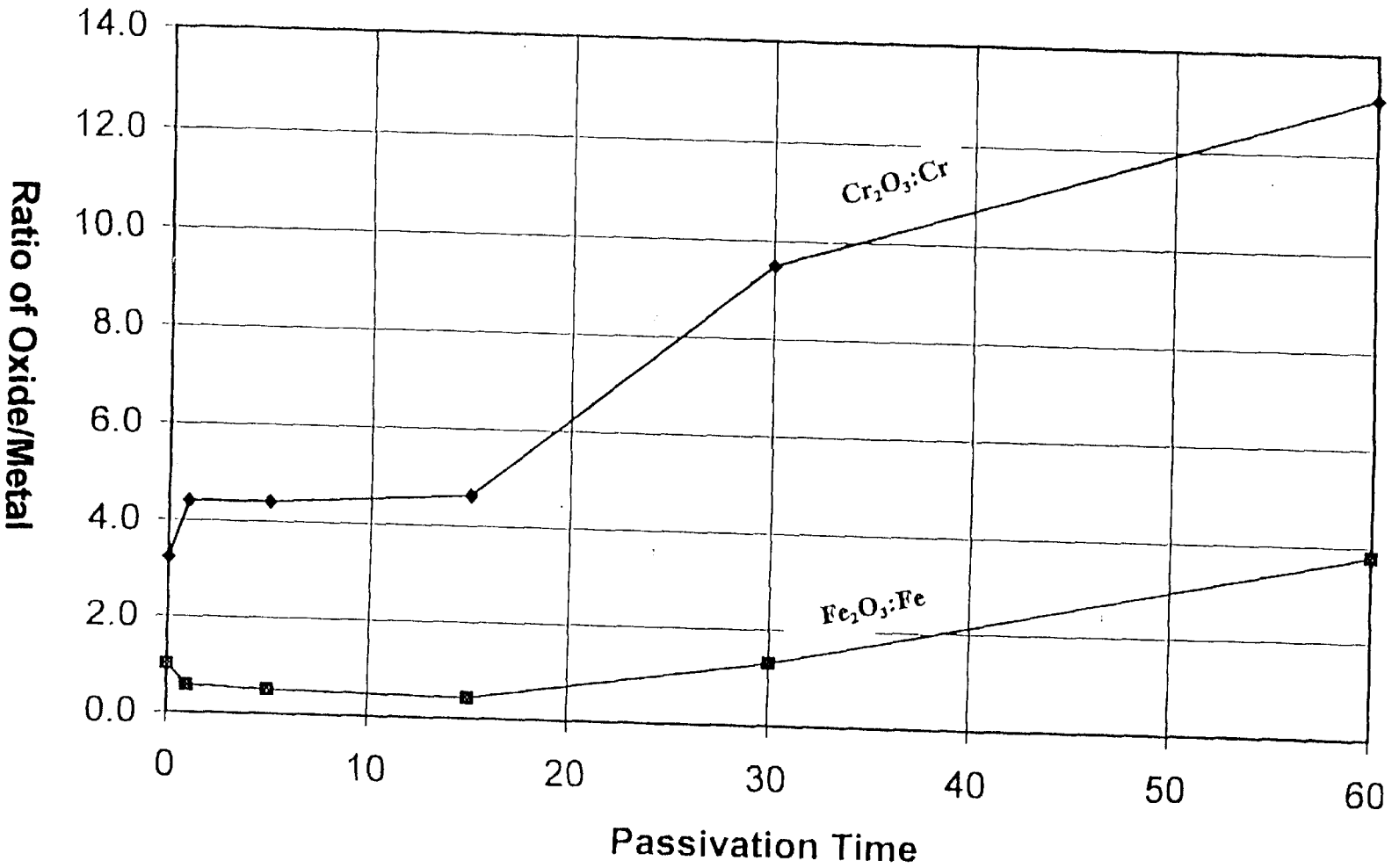
FIG. 3 is a graph showing the ratio change of $Cr_2O_3$:Cr and $Fe_2O_3$:Fe as a function of passivation time.

Examination of the specific binding energy peaks for each element indicate that both oxide and metal are present, that is, metal with a valence of zero. In the case of iron, both the oxide and elemental iron are present in significant quantities. This is especially the case for elemental iron at passivation times less than 30 minutes. Table 6 and FIG. 3 present the ratios of the iron and chromium to their respective oxides.

These data indicate that the iron oxide abruptly decreases after one minute and continues to drift downward until the chromium oxide reaches a near saturation point somewhere between 15 and 30 minutes. After 30 minutes, both ratios increase, although the rate of increase is greater for chromium oxide than for iron oxide. This would indicate that the surface is becoming more passive with longer exposure to the hot nitric acid.

TABLE 5

Composition as a Function of Depth for 60 Minute Nitric acid Passivated Type 316L

| Depth, Å | C | N | O | Si | P | Ar | Ca | Cr | Fe | Ni | Mo |
|---|---|---|---|---|---|---|---|---|---|---|---|
| 0 | 28.8 | 1.8 | 49.9 | 1.1 | 0.4 | — | — | 10.5 | 6.7 | 0.5 | 0.3 |
| 25 | 8.6 | 0.3 | 49.8 | 0.9 | 0.3 | 1.2 | 0.1 | 17.2 | 19.6 | 1.7 | 0.4 |
| 50 | 5.6 | 0.4 | 47.8 | 0.8 | 0.1 | 1.5 | 0.2 | 17.1 | 24.0 | 2.1 | 0.5 |
| 100 | 4.0 | 0.3 | 45.2 | 0.5 | 0.1 | 1.7 | — | 18.1 | 27.7 | 2.1 | 0.5 |

TABLE 5-continued

| Composition as a Function of Depth for 60 Minute Nitric acid Passivated Type 316L | | | | | | | | | | | |
|---|---|---|---|---|---|---|---|---|---|---|---|
| Depth, Å | C | N | O | Si | P | Ar | Ca | Cr | Fe | Ni | Mo |
| 200 | 4.0 | 0.3 | 45.2 | 0.5 | 0.1 | 1.7 | — | 18.1 | 27.7 | 2.1 | 0.6 |
| 400 | 3.0 | — | 29.1 | 0.1 | — | 1.7 | — | 17.2 | 35.8 | 2.3 | 0.8 |
| 800 | 2.0 | — | 33.7 | — | — | 1.8 | 0.1 | 17.3 | 41.3 | 2.7 | 1.1 |
| 1600 | 2.1 | — | 24.3 | — | — | 1.8 | — | 17.7 | 49.2 | 3.4 | 1.4 |
| 3200 | 1.8 | — | 12.8 | — | — | 2.1 | — | 17.1 | 60.0 | 4.3 | 1.9 |

TABLE 6

| Ratio of Iron and Chromium Oxide to the Metal for Various Passivation Times | | | | | | |
|---|---|---|---|---|---|---|
| | 0 minutes | 1 minute | 5 minutes | 15 minutes | 30 minutes | 60 minutes |
| $Fe_2O_3/Fe^0$ | 1.0:1 | 0.5:1 | 0.4:1 | 0.3:1 | 1.5:1 | 3.8:1 |
| $Cr_2O_3/Cr^0$ | 3.2:1 | 4.5:1 | 4.5:1 | 4.5:1 | 8.5:1 | 13.0:1 |

A passivation treatment of mechanically polished Type 316L stainless steels appears necessary to enhance its corrosion resistance. Mechanical polishing destroys the passive layer formed during manufacture of the strip and tube. The passive layer is quite thin, in the order of 50–400 Å, or 12–150 atoms thick. Although swirl polishing does not remove a measurable amount of metal, the passive layer is destroyed as evidenced by surface oxidation. When these oxidized surfaces are dipped in hot nitric acid the colors disappear, indicating removal of iron oxides. Thus, passivation following polishing is a necessary operation.

Figure 4A:
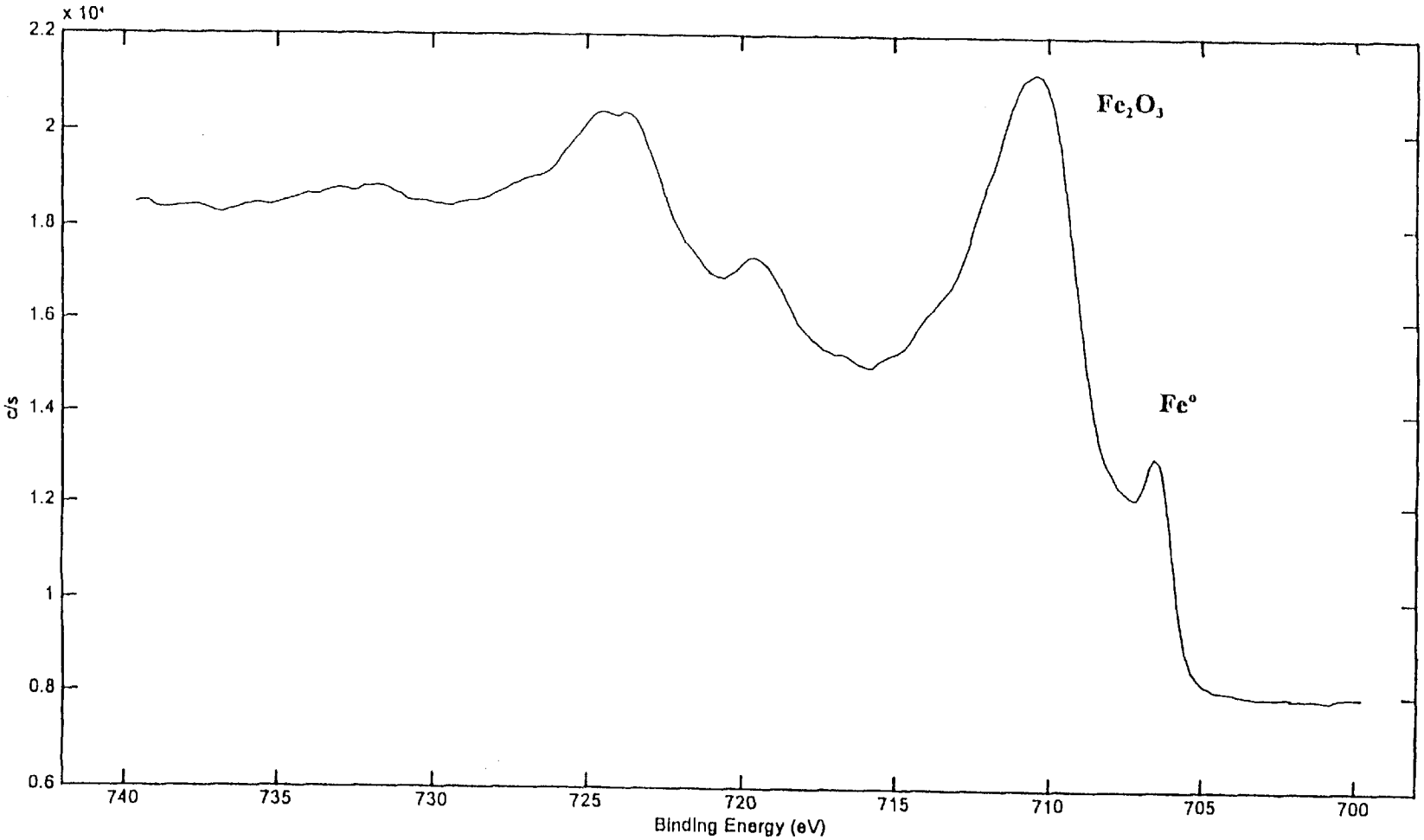
FIG. 4*a* is a graph constituting an iron binding energy scan showing relative oxide and free iron levels.
Figure 4B:
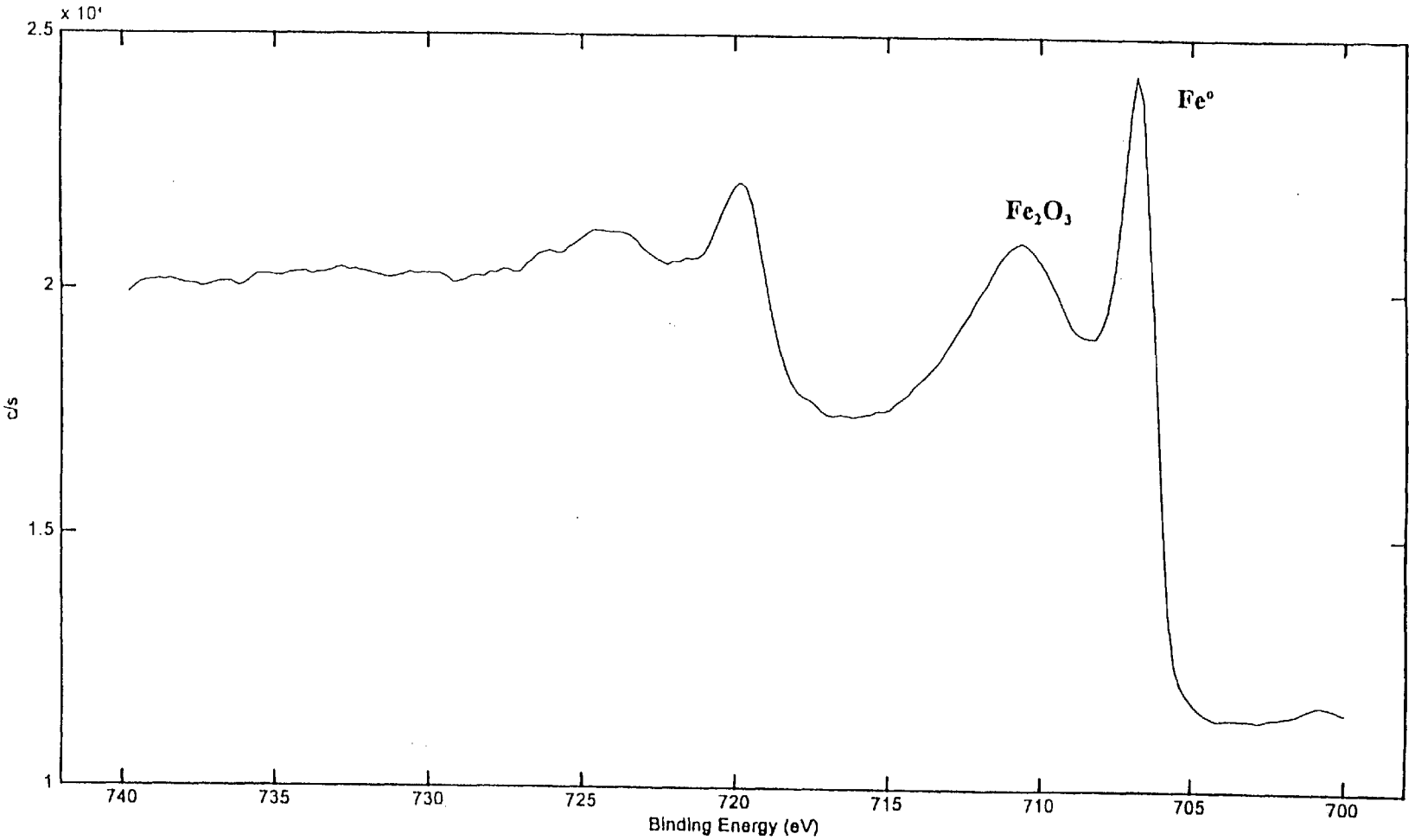
FIG. 4*b* is a graph constituting an iron binding energy scan after one minute passivation showing the decrease in oxide and increase in free iron.
Figure 5A:
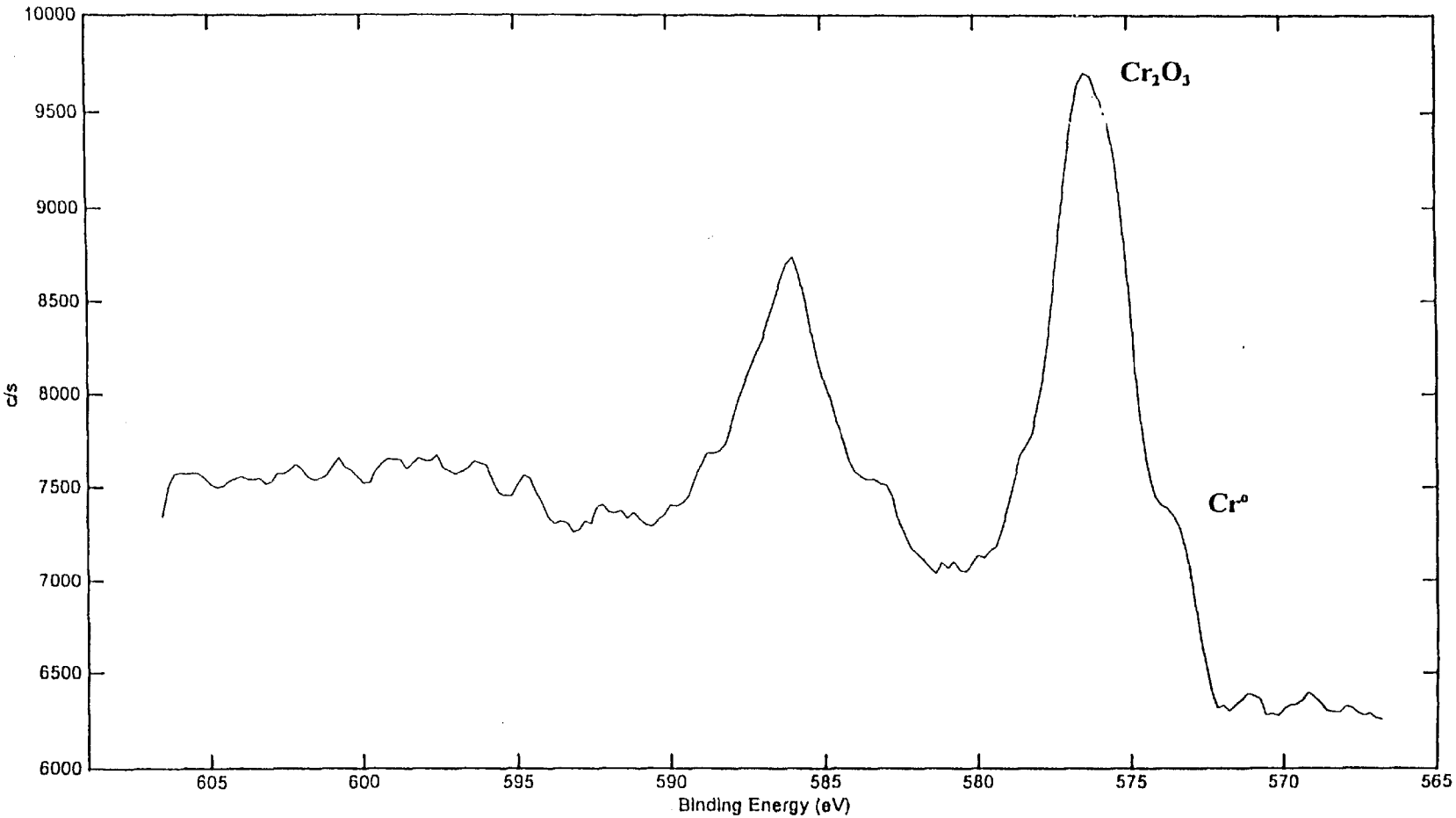
FIG. 5*a* is a graph constituting a chromium binding energy scan of material without passivation showing relative oxide to free chromium levels.
Figure 5B:
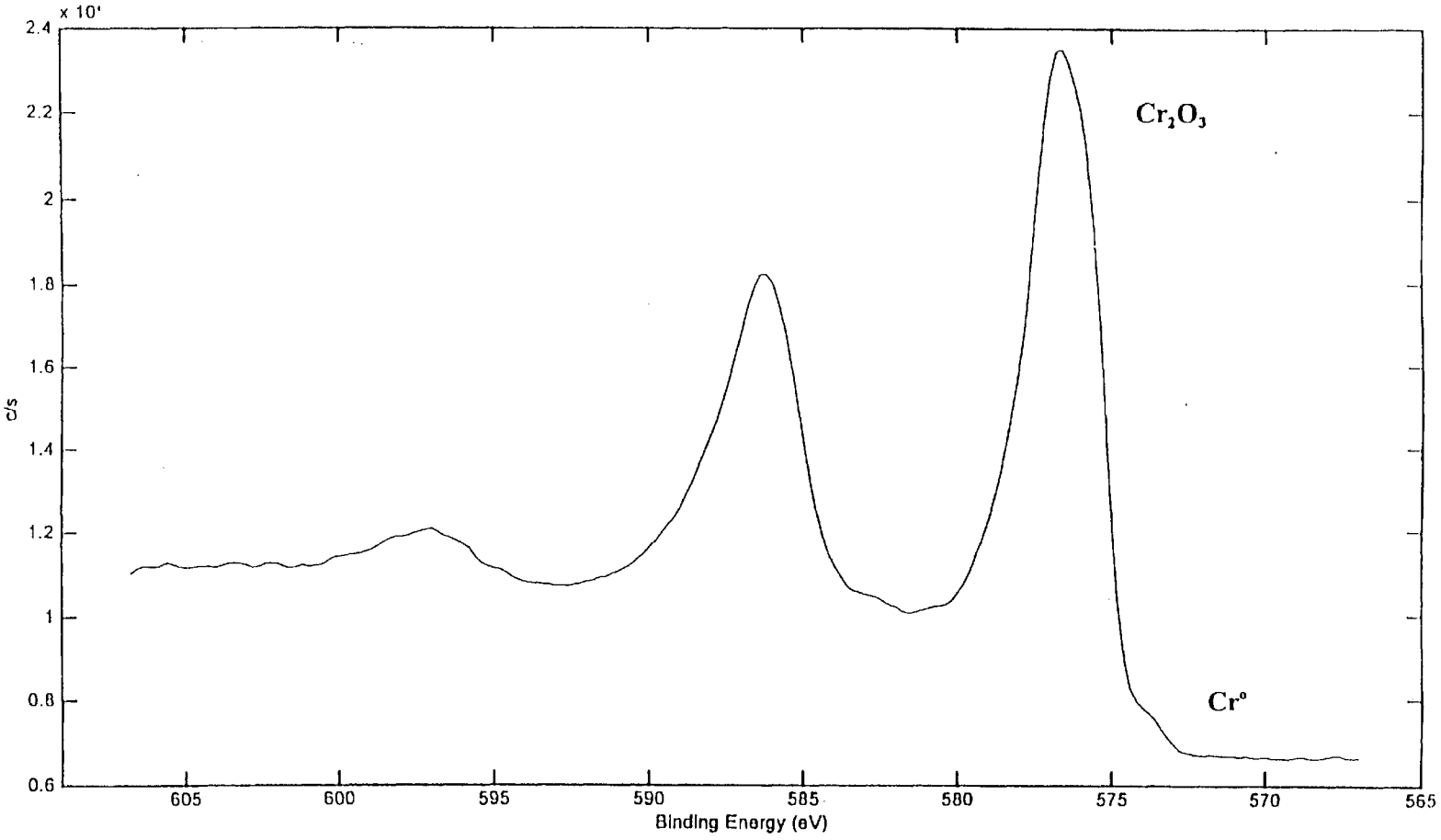
FIG. 5*b* is a graph constituting a chromium binding energy scan of material after 60 minutes showing the decrease in free chromium.
Figure 6:
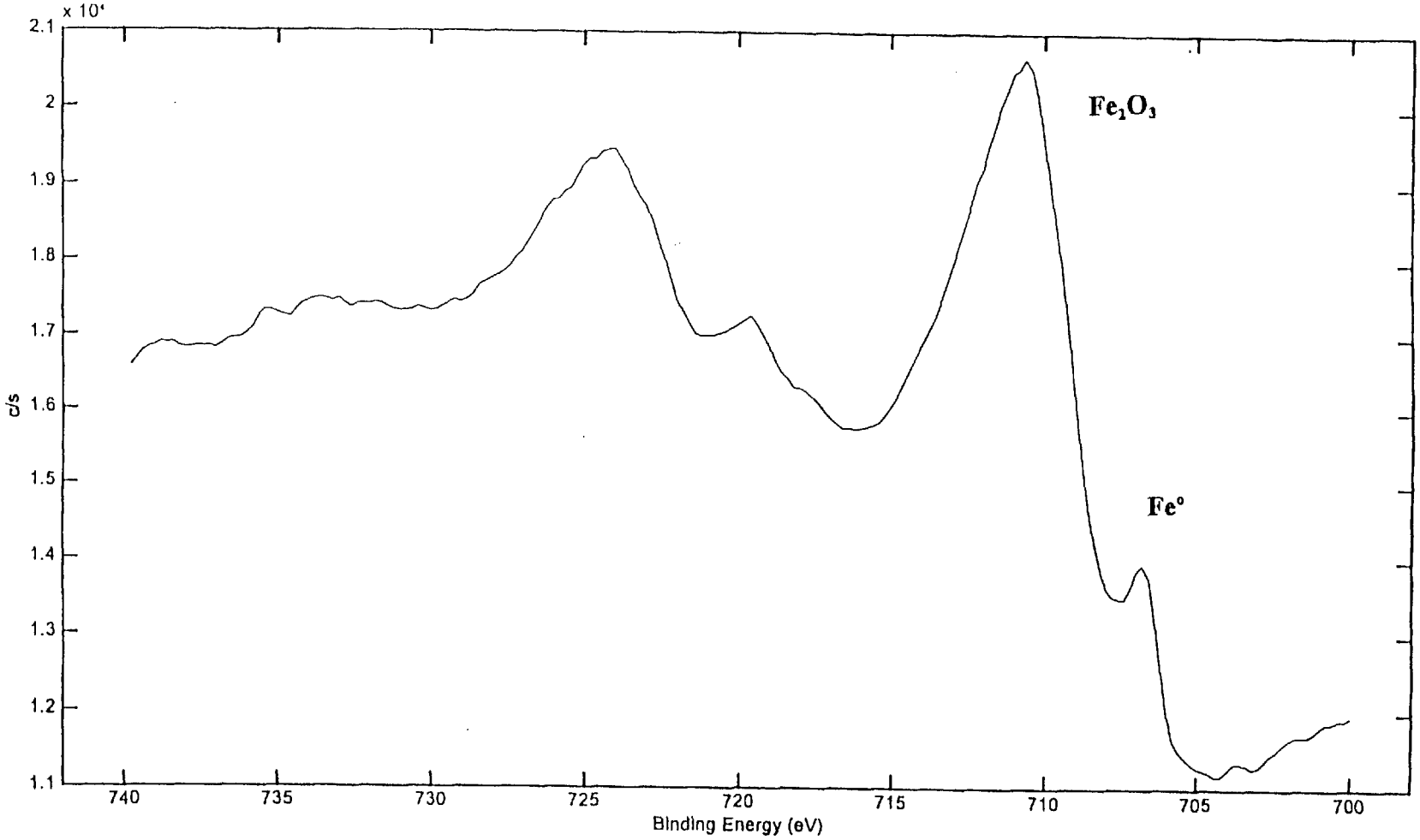
FIG. 6 is a graph constituting a binding energy scan of 60 minutes passivated material showing significant residual free iron.

The most dramatic change in surface chemistry occurs after only one minute in hot nitric acid during which time the surface Cr/Fe ratios change from 0.26:1 to 1.1:1. These ratios may vary according to the type of analytical instrument used: Auger electron spectroscopy (AES) tends to give lower values than XPS. Much of this change appears to be the dissolution of surface iron oxide as seen in FIGS. 4*a* and 4*b*. A careful examination of the binding energy curves for both iron and chromium shows the metallic chromium (valence zero), FIGS. 5*a* and 5*b*, steadily drops with increasing passivation time and chromium oxide increases. Metallic iron, however, remains a significant species, even after 60 minutes passivation, as seen in FIG. 6. Electropolished material by comparison exhibits very little metallic iron, which suggests that it will have better corrosion resistance.

The mechanism for passivation appears to be related to the progressive oxidation of chromium as the first step. Once the free chromium is essentially consumed, iron begins to form its oxide. The atmosphere formed iron oxide, which was dominant in the as-received material, rapidly dissolved in the hot nitric acid and metallic iron remains the dominant species up to 30 minutes where the amount of oxide finally exceeds that of the metallic iron. True passivation does not appear to occur until the metallic elements are essentially all converted to the oxide. For mechanically polished material this will be in excess of 60 minutes passivation in hot nitric acid.

The following was concluded from this experimental work:

1. Rather dramatic changes occur in the surface chemistry of mechanically polished Type 316L during passivation. Iron decreases as does silicon, nickel, and molybdenum. Oxygen and chromium both increase. The Cr/Fe ratio increases with passivation time.

2. The passivation mechanism appears to be controlled by the oxidation of metallic chromium to the trivalent oxide. Iron does not begin to form appreciable trivalent oxide until chromium is satiated.

3. Even after 60 minutes passivation in hot nitric acid, a definite metallic iron peak still remains, indicating that further passivation could occur.

Electropolishing has not been recognized as a means of producing an enhanced finish except within a very limited area, namely the pharmaceutical and semiconductor industries. Electropolishing is acknowledged as a means of producing a surface that is free from adventitious iron contamination, extremely smooth, essentially free from surface blemishes, with a high glossy surface that approaches chromium plating. Also, electropolished surfaces are recognized as having improved corrosion resistance over mechanically polished surface.

With the advent of specialized analytical equipment, it was possible to determine exactly what was happening on the surface. Auger Electron Spectroscopy (AES) was the first of these techniques making its debut only three decades ago. Somewhat later, "sputtering" with ionized argon was developed, allowing AES to determine composition as a function of distance from the surface. FIG. 7 represents a typical AES depth profile of an electropolished surface. The major problem with AES is that only the elements are reported, not their molecular form.

Another very useful analytical technique developed about the same time is Energy Dispersive Spectroscopy (EDS). This also is an elemental analytical method and may be used in conjunction with the scanning electron microscope as a microprobe to identify the composition of small particles, such as inclusions in steel.

A newer technique, Electron Spectroscopy for Chemical Analysis (ESCA), also known as X-ray Photoelectron Analysis or XPS, uses x-rays instead of electrons. This method has the advantage of identification of the molecular species. Some differences exist between the reported values for XPS, AES, and EDS. The reason for this is not fully understood, but is generally attributed to the difference in depth of analysis, spot size, and the type of spectra generated. A comparison of the three analytical techniques is given in Table 7.

TABLE 7

| Comparison of Analytical Techniques | | | |
|---|---|---|---|
| Technique | Auger Electron Spectroscopy (AES) | X-Ray Photoelectron Spectroscopy (XPS) | Energy Dispersive Spectroscopy (EDS) |
| Probe Beam | Electrons | X-Rays | Electrons |
| Detection Beam | Auger Electrons | Photoelectrons | X-Rays |
| Element Range | 3–92 | 2–92 | 5–92 |
| Detection Depth | 30Å | 30Å | 1 $\mu$m |
| Detection Limits | $1 \times 10^{-3}$ | $1 \times 10^{-4}$ | $1 \times 10^{-5}$ |
| Accuracy | 30% | 30% | 10% |
| Identify Organics? | No | Some | No |
| Identity Chemical State? | Some | Yes | No |

Because XPS can identify the chemical state of the element and can be used with sputtering to obtain a depth profile, it allows evaluation of the surface treatments that enhance the corrosion resistance. For this reason, XPS was used as the primary evaluation tool. The primary means of comparison was Cr/Fe ratio. Other ratios of interest included the ratio of the oxides $Cr_2O_3/Cr^0$:$Fe_2O_3/Fe^0$. The latter ratio is probably the best to describe the passivation techniques since it allows following the relative oxidation rate for the different metals.

Additional experimental work were performed to examine both electropolishing and passivation as a means of enhancing the corrosion resistance. In addition, the effect of orbital welding on surfaces with enhanced properties was considered.

As discussed and demonstrated above, as-mechanically polished surfaces have very low Cr/Fe ratios. This is demonstrated by the data presented in Table 8. As also discussed and demonstrated above, "air passivation" will not improve the Cr/Fe ratio. Placing air passivated surfaces in service without passivation may lead to accelerated "rouging" in high purity water applications. Proper passivation will greatly improve the Cr/Fe ratios in every case.

TABLE 8

Comparison of Tubing Cr/Fe Ratios Using Various Polishing Techniques

| Polishing Method | Cr/Fe Ratio |
|---|---|
| Electropolished, No Passivation | 0.82 |
| Longitudinal Belt, No Passivation | 0.28 |
| Rotary Swirl, No Passivation | 0.33 |

Electropolishing is simply electroplating in reverse. The process involves pumping a solution of concentrated sulfuric and phosphoric acids through the interior of the tube, while direct current is applied. The metal is dissolved from the tube (anode) and the cathode would be plated if the solution chemistry was not balanced to dissolve the metals as fast as they are plated. Because oxygen is liberated at the tubing surface, the resulting passive layer has a high $Cr_2O_3/Fe_2O_3$ ratio. This result is a very smooth surface with a high luster. A full description of this process is set forth in "Electropolished Stainless Steel Tubing," J. C. Tverberg, *TPJ—The Tube and Pipe Journal,* September/October 1998.

Normally, surface finish is measured with a profilometer and normally expressed as Ra or average roughness. However roughness alone is not sufficient to describe the true nature of the surface. Use of a scanning electron microscope together with the profilometer gives the best surface analysis.

Industry normally buys electropolished tubing to either a 10$\mu$-inch (0.25 $\mu$m) maximum or 15$\mu$-inch (0.38 $\mu$m) maximum surface roughness. There is a difference in how these two finishes are obtained, depending on how the surfaces are prepared prior to electropolishing. Generally, as discussed above, two methods of mechanical polishing are used to prepare the surface. For the smoothest surface, the interior tubing surfaces are polished using a longitudinal belt. This removes the most metal from the ID surface, below the depth of fabrication induced defects. When electropolished, surface finishes of 2–5$\mu$-inches (0.05–0.12 $\mu$m) are not uncommon. The other method of mechanical polishing uses rotating flapper wheels producing a swirl finish. When electropolished, surface finishes in the range of 8–13$\mu$-inches (0.20–0.33 $\mu$m) are attained. Swirl polishing removes very little metal, producing a "smeared" surface, so few surface defects are removed. A highly cold worked and bright hydrogen annealed surface will result in essentially the same surface finish. In both cases the Cr/Fe ratios will be nearly the same.

As demonstrated by the experimental work discussed above, passivation has the effect of introducing oxygen into the surface layer and dissolving other elements, leaving chromium and iron as the two primary surface metals. Both carbon and oxygen are in high concentration. Some of the carbon and oxygen are from occluded carbon dioxide. The carbon appears higher in mechanically polished surfaces than electropolished surfaces.

These investigations to date involved 20% nitric acid at 50° C. and at 25° C., and 20% nitric acid 1% hydrofluoric acid at both 50° C. and 25° C. The passivation times varied with solution and temperature. Two additional passivation treatments are planned for later study: 10% citric+5% EDTA and 5% orthophosphoric acid.

The effect of color tinted electropolished surfaces on the composition of the passive layer was studied. Gold tints appear to have all the $Cr^0$ and $Fe^0$ oxidized to the trivalent oxides and show extremely high Cr/Fe ratios. When the color shifts to the blue, the iron begins to form $Fe_3O_4$, also expressed as $Fe_2O_3FeO$, and the chromium content drops as seen in the FIG. 9 depth profile.

The latest passivation studies involve swirl polished, swirl polished+electropolished, and longitudinal belt+electropolished surfaces. The highest Cr/Fe ratio, 4.04, was attained on the swirl polish only in hot nitric acid after 20 minutes, and that Cr/Fe ratio decreased after 30 minutes to 3.15. Table 9 compares the various passivation treatments for the different starting materials.

TABLE 9

Effect of Various Passivation Treatments on Cr/Fe Ratio

| | No Pass | 20% $HNO_3$ at 50° C. | | 20% $HNO_3$ at 25° C. | | 20% $HNO_3$ + 1% HF at 50° C. | | | 20% $HNO_3$ + 1% HF at 25° C. | | |
|---|---|---|---|---|---|---|---|---|---|---|---|
| Treatment | 0 min. | 20 min | 30 min | 10 min | 30 min | 5 min | 10 min | 20 min | 5 min | 10 min | 30 min |
| Swirl Only | 0.33 | 4.04 | 3.15 | 2.95 | 2.09 | 2.59 | 1.52 | 1.15 | 2.58 | 2.45 | 1.58 |
| Swirl + EP | 1.33 | 2.23 | 1.94 | 2.34 | 2.04 | 1.82 | 1.52 | 2.07 | 2.13 | 2.08 | 2.20 |
| Belt + EP | 0.82 | 1.69 | 1.91 | 2.05 | 2.01 | 2.16 | 1.77 | 2.15 | 1.75 | 2.24 | 2.20 |

In each case where the Cr/Fe ratio decreases with extended passivation time, there is an increase in the amount of free iron with respect to the iron oxide and chromium metal to the chromium oxide. This suggests that the surface layers are dissolving, and the substrate is struggling to regain the proper Cr/Fe balance. This is logical with the use of hydrofluoric acid since it is a halogen acid which readily attacks chromium.

Orbital welds on a swirl polished type 316L stainless steel tube were analyzed using XPS. In this study the weld bead, a slag deposit on the weld bead, and the dark oxide on the heat affected zone were analyzed. The data are presented in Table 10.

TABLE 10

| | Composition of Orbital Weld Components | | | | | | | | |
|---|---|---|---|---|---|---|---|---|---|
| Element | Cr | Fe | Ni | Mo | Mn | Si | Al | Ca | Cr/Fe |
| Weld Bead | 4.3 | 37.8 | 0.8 | 0.3 | 4.6 | 0.5 | — | — | 0.11 |
| Slag Patch | 1.9 | 5.3 | — | — | 2.0 | 4.0 | 1.4 | 12.9 | 0.36 |
| HAZ Oxide | 16.2 | 3.0 | — | 0.1 | 21.5 | 2.7 | — | 0.3 | 5.40 |
| Base Metal | 14.9 | 23.6 | — | 0.1 | 3.0 | 0.8 | — | 0.4 | 0.63 |

These results show that the unpassivated weld has a very low Cr/Fe ratio. Ideally, the Cr/Fe ratio should be 1.0 or higher to have reasonably good corrosion resistance. Depth profiles using XPS on these areas were not run, but based on EDS analyses, the chromium content increased with depth. Chromium was highly variable from sample to sample, probably dependent on whether the electron probe was analyzing delta ferrite or austenite. The results are consistent with other EDS analytical work where the weld surfaces usually showed high manganese and low chromium.

Likewise, the slag patch is consistent with other findings. The slag appeared to be an accumulation of the inclusions in the steel or incomplete gas coverage allowing oxidation of the weld pool. In this case, the slag spot appears to have come from the inclusions in the steel and that the steel was deoxidized with calcium and aluminum.

The dark oxide area over the heat affected zone had the highest chromium level and the lowest iron of the analyses made. When compared to actual corrosion failures in the field, the dark oxide appears to remain intact, and acts as a crevice former with crevice corrosion occurring under the dark oxide. This suggests that the high chromium makes this dark oxide quite corrosion resistant, thus allowing galvanic corrosion to attach the surface under the oxide.

Several significant observations mark the difference between a mechanically polished surface, an electropolished, a passivated, and the surface of the orbital welds. These are:

1. The mechanically polished surface essentially has all the elements present in the alloy, and in the same approximate ratios.
2. Both electropolished and passivated surfaces show no molybdenum and very little nickel. Essentially the only two elements of any significance are chromium and iron, although silicon is variable and in the case of electropolished surfaces may change its valence form.
3. Electropolished surfaces tend to have a deeper depth of oxygen penetration than passivated surfaces.
4. Surfaces passivated for the proper time appear to have higher surface Cr/Fe ratios, but not the depth of oxygen penetration.
5. The $Cr_2O_3/Cr^0$ ratios appear to control the passivation process.
6. The $Fe_2O_3/Fe^0$ ratio may have a greater impact on passivation, thus corrosion resistance, than the Cr/Fe ratio. The lower the $Fe^0$, the more stable the passive layer.
7. Orbital welds have a surface very low in chromium and high in iron. Manganese likewise is elevated.
8. The dark oxide over the heat-affected zone of orbital welds is very high in chromium, low in iron, and generally associated with crevice corrosion in the field.
9. Slag deposits that occasionally appear on the orbital weld surface appear to be low melting refractory compounds that arise from the inclusions in the steel or oxidation of weld pool.

These observations suggest that the passive layer may actually be crystalline in nature. The closest crystal form is chromite spinel, which has the general formula $(Fe,Mg)O.(Cr,Fe)_2O_3$. This crystal has the oxygen atoms arranged on a face centered cubic lattice (Dana et al., *A Textbook of Mineralogy*, John Wiley & Sons, New York, 1951), thus matching the crystal lattice of austenitic stainless steel. Also, because of the crystal's composition, it would explain the lack of certain elements in the surface layers of both passivated and electropolished material and provide a reason why the passivation process takes time in an oxidizing solution to allow the crystal to form. A surface high in iron will not form the proper crystal, and therefore will lack chemical stability.

Because the composition of an orbital weld is low in chromium, the resulting surface crystal will be either hematite ($Fe_2O_3$) or magnetite ($Fe_3O_4$), neither of which has corrosion resistance. Therefore, the surface must be acid passivated to first dissolve the excess iron, then to allow chromium to become the dominant element.

The dark oxide over the heat-affected zone has the general composition of chromite, $FeCr_2O_4$, or $FeO.Cr_2O_3$. The composition may have considerable variation, but in all cases it is very high in chromium. This gives the crystal excellent corrosion resistance in oxidizing media, probably far more than the metal it covers. This will lead to conditions for galvanic corrosion (crevice corrosion) and explains the type of corrosion observed in those systems that have had poor gas coverage during welding. The only rectification is to chemically dissolve the oxide, usually with a nitric+hydrofluoric acid, which should passivate the entire system. However, this treatment may destroy an electropolished surface.

The following was concluded and further establishes from this additional experimental work:

1. The interior of stainless steel tubing can be conditioned to increase the service life. The two most common systems are electropolishing and acid passivation. In either case the Cr/Fe ratio needs to approach or exceed 1.0 to achieve the best corrosion resistance.
2. The amount of free iron in the passive layer is critical for stability of the layer. If the free iron exceeds the iron oxide, then the film will not be stable, which may lead to a breakdown in service.
3. Passivation reaches an optimum Cr/Fe ratio within a relatively short time, then appears to reverse itself.
4. Some characteristics of the passive layer suggest that it may be crystalline in nature, taking the characteristics of chromite spinel.
5. Orbital weld surfaces are high in iron and manganese, but very low in chromium, suggesting that the as-welded surfaces are poor in corrosion resistance.
6. The dark oxide that may cover the heat-affected zone of the weld is very high in chromium and low in iron. This suggests the oxide is chromite, which has very good corrosion resistance.
7. Slag spots that sometimes appear on weld surfaces are accumulated inclusions from the steel. Under conditions of poor gas coverage these slag spots may be oxidation of silicon, iron, and chromium in the molten weld pool.

Other embodiments of the present invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A stainless steel article having a passivated surface layer wherein said passivated surface layer consists essentially of an oxide component having $Cr_2O_3$ and $Fe_2O_3$, and a metal component having Fe with zero valence and Cr with zero valence and the ratio of the oxide component to the metal component being in excess of 8:1.

2. The article of claim 1, wherein said stainless steel is an austenitic stainless steel.

3. The article of claim 2, wherein said stainless steel is AISI Type 316.

4. The article of claim 1, wherein an exposed surface of said passivated surface layer will have total Cr:Fe ratio of at least 1:1.

5. The article of claim 1, wherein said passivated surface layer at a depth therein of a maximum oxygen concentration has total Cr:Fe ratio of at least 1.5:1.

6. A stainless steel tubing having a passivated interior surface layer on an electropolished interior surface of said tubing article wherein said passivated surface layer consists essentially of an oxide component having $Cr_2O_3$ and $Fe_2O_3$, and a metal component having Fe with zero valence and Cr with zero valence and the ratio of the oxide component to the metal component being in excess of 8:1.

7. The tubing of claim 6, wherein said stainless steel is an austenitic stainless steel.

8. The tubing of claim 7, wherein said stainless steel is AISI Type 316L.

9. A stainless steel article having a passivated surface layer on a mechanically polished surface of said article, wherein said passivated surface layer consists essentially of an oxide component having $Cr_2O_3$ and $Fe_2O_3$, and a metal component having Fe with zero valence and Cr with zero valence and the ratio of the oxide component to the metal component being in excess of 8:1.

10. The article of claim 9, wherein said stainless steel is an austenitic stainless steel.

11. The article of claim 10, wherein said stainless steel is AISI Type 316.

12. The article of claim 9, wherein an exposed surface of said passivated surface layer will have total Cr:Fe ratio of at least 1:1.

13. The article of claim 9, wherein said passivated surface layer at a depth therein of a maximum oxygen concentration has total Cr:Fe ratio of at least 1.5:1.

14. The article of claim 9, wherein an exposed surface of said passivated surface layer will have total Cr:Fe ratio of at least 1:1.

15. The article of claim 9, wherein said passivated surface layer at a depth therein of a maximum oxygen concentration has a total Cr:Fe ratio of at lest 1.5:1.

16. A stainless steel tubing having a passivated interior surface layer on a mechanically polished interior surface of said article, wherein said passivated surface layer consists essentially of an oxide component having $Cr_2O_3$ and $Fe_2O_3$, and a metal component having Fe with zero valence and Cr with zero valence and the ratio of the oxide component to the metal component being in excess of 8:1.

17. The tubing of claim 16, wherein said stainless steel is an austenitic stainless steel.

18. The tubing of claim 17, wherein said stainless steel is AISI Type 316.

19. The tubing of claim 16, wherein an exposed surface of said passivated surface layer will have total Cr:Fe ratio of at least 1:1.

20. The tubing of claim 16, wherein said passivated surface layer at a depth therein of a maximum oxygen concentration has total Cr:Fe ratio of at least 1.5:1.

* * * * *

UNITED STATES PATENT AND TRADEMARK OFFICE

CERTIFICATE OF CORRECTION

PATENT NO. : 6,228,445 B1
DATED : May 8, 2001
INVENTOR(S) : John C. Tverberg

It is certified that error appears in the above-identified patent and that said Letters Patent is hereby corrected as shown below:

Column 14, claim 14,
Line 11, "claim 9" should read -- claim 6 --.

Column 14, claim 15,
Line 14, "claim 9" should read -- claim 6 --.

Signed and Sealed this

Twenty-fifth Day of December, 2001

*Attest:*

*Attesting Officer*

JAMES E. ROGAN
*Director of the United States Patent and Trademark Office*